US005755605A

United States Patent [19]

Äsberg

[11] Patent Number: 5,755,605

[45] Date of Patent: May 26, 1998

[54] PROPELLER DRIVE UNIT

[75] Inventor: Michael Äsberg, Torslanda, Sweden

[73] Assignee: AB Volvo Penta, Gothenburg, Sweden

[21] Appl. No.: 765,680

[22] PCT Filed: Jun. 27, 1995

[86] PCT No.: PCT/SE95/00791

§ 371 Date: Jan. 23, 1997

§ 102(e) Date: Jan. 23, 1997

[87] PCT Pub. No.: WO96/00683

PCT Pub. Date: Jan. 11, 1996

[30] Foreign Application Priority Data

Jun. 28, 1994 [SE] Sweden ..... 9402272

[51] Int. Cl.[6] ..... B63H 20/14

[52] U.S. Cl. ..... 440/75; 440/80

[58] Field of Search ..... 440/3, 4, 49, 79, 440/80; 114/56, 57, 144 R, 150

[56] References Cited

U.S. PATENT DOCUMENTS

| | | | |
|---|---|---|---|
| 3,330,239 | 7/1967 | Dornak | 114/56 |
| 4,815,996 | 3/1989 | Carr . | |
| 5,134,949 | 8/1992 | Almog et al. | 114/56 |

*Primary Examiner*—Stephen Avila
*Attorney, Agent, or Firm*—Young & Thompson

[57] ABSTRACT

A propeller drive installation in a boat has two propeller drive units (8, 9) which extend out through individual openings (4, 5) in the bottom (1) of a V-bottomed boat, so that the legs are inclined relative to each other. The leg of one drive unit can be set to turn the boat in one direction at the same time as the leg of the other drive unit can be set to turn the boat in the opposite direction, so that the horizontal counteracting forces acting on the legs cancel each other, while the vertical forces are added to each other to trim the running position of the boat in the water.

3 Claims, 3 Drawing Sheets

PROPELLER DRIVE UNIT

Figure 1:
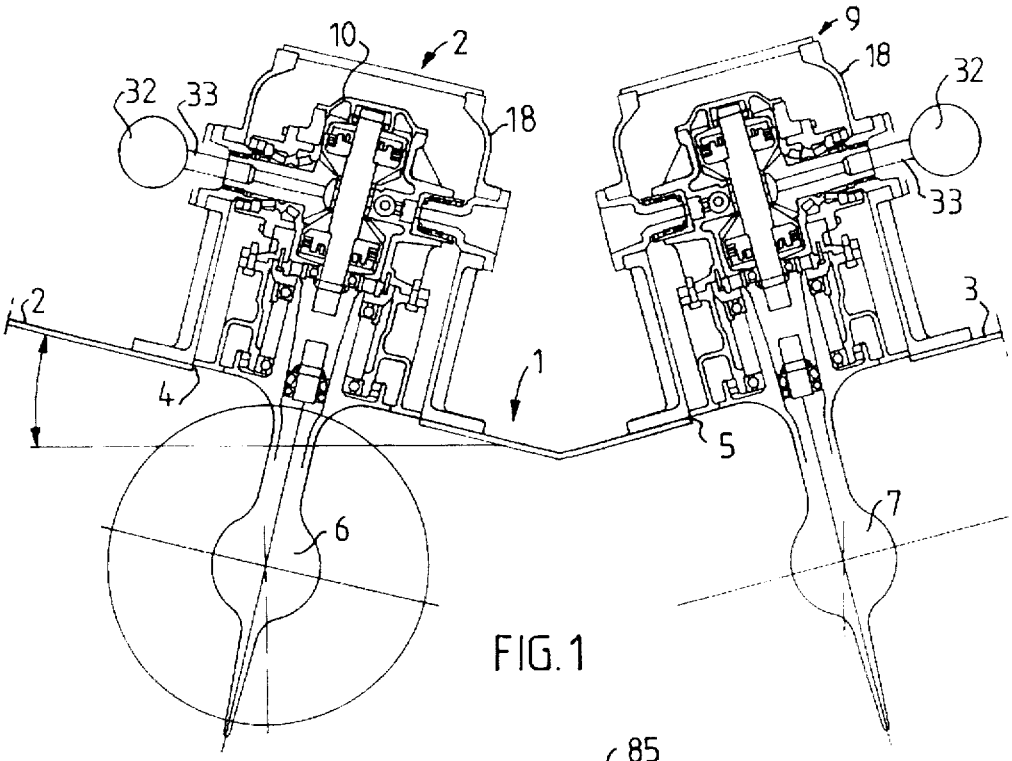

The present invention relates to a propeller drive installation in a boat, comprising at least two propeller drive units coupled to a drive plant, said drive units each having a first angle gearing enclosed in an upper gear housing and having first and second shafts, of which one is an input shaft intended to be coupled to a drive plant, and a drive unit leg extending downward from the upper gear housing with a second angle gearing enclosed in a lower gear housing and having at least one propeller shaft.

Marine drive plants can, in principle, be divided into two main groups, firstly, traditional inboard installations, in which the engine and transmission (reversing gear) are placed inboard and are coupled to a relatively long, rigid propeller shaft which extends obliquely downwards and aft and out through a sealed bearing in the bottom of the boat, and, secondly, so-called inboard-outboard drive installations, in which a motor mounted inboards is coupled to a propeller drive unit with a propeller leg, which is completely or partially disposed on the outside of the boat hull and has a lower bevel gear with a short horizontal propeller shaft. In the most common type of inboard-outboard drive, the propeller drive unit is tiltably and pivotally hung on a shell mounted on the outside of the boat transom. This type of drive is often twin mounted in fast motorboats of up to 35 ft in length, and the drives are always mounted with the legs parallel to each other.

In order to quickly get a fast planing boat up into the planing position and in order to trim the running position of the boat to adjust for load distribution and wind conditions, flaps, so-called trim tabs, hinged to the lower portion of the transom, are used. They can be maneuvered from the helm position with the aid of electrical or hydraulic means.

The purpose of the present invention is to achieve a drive installation of the type described by way of introduction which is arranged so that the drives can take over the function of the known trim tabs, so that they can be eliminated.

This is achieved according to the invention by virtue of the fact that the drives are mounted beside each other with their respective legs inclined relative to each other, so that the distance between the lower gear housings is greater than the distance between the upper gear housings, and in that one leg is settable to turn the boat in one direction at the same time as the other leg is settable to turn the boat in the opposite direction, whereby the counteracting horizontal force components cancel each other, while the vertical force components are added to each other to trim the running position of the boat in the water.

In a preferred embodiment of the drive installation according to the invention, the drive unit legs each extend through an individual opening in a V-bottomed boat, each drive unit leg having an upper portion which is mounted in rolling bearings in a bearing housing fixed to the upper gear housing.

The rotatable mounting of the drive unit leg relative to the upper gear housing provides unsurpassed maneuverability in comparison to the completely inboard installation and is better than conventional inboard-outboard drives, which all have a limited steering angle range. A drive unit leg rotatably projecting through an opening in the boat bottom can theoretically be rotated 360° and thus, when rotated 90° from a position for dead ahead propulsion, can function in the same manner as a bow propeller, i.e. exerting purely lateral forces on the boat hull and thus making docking and casting off much easier.

Figure 3:
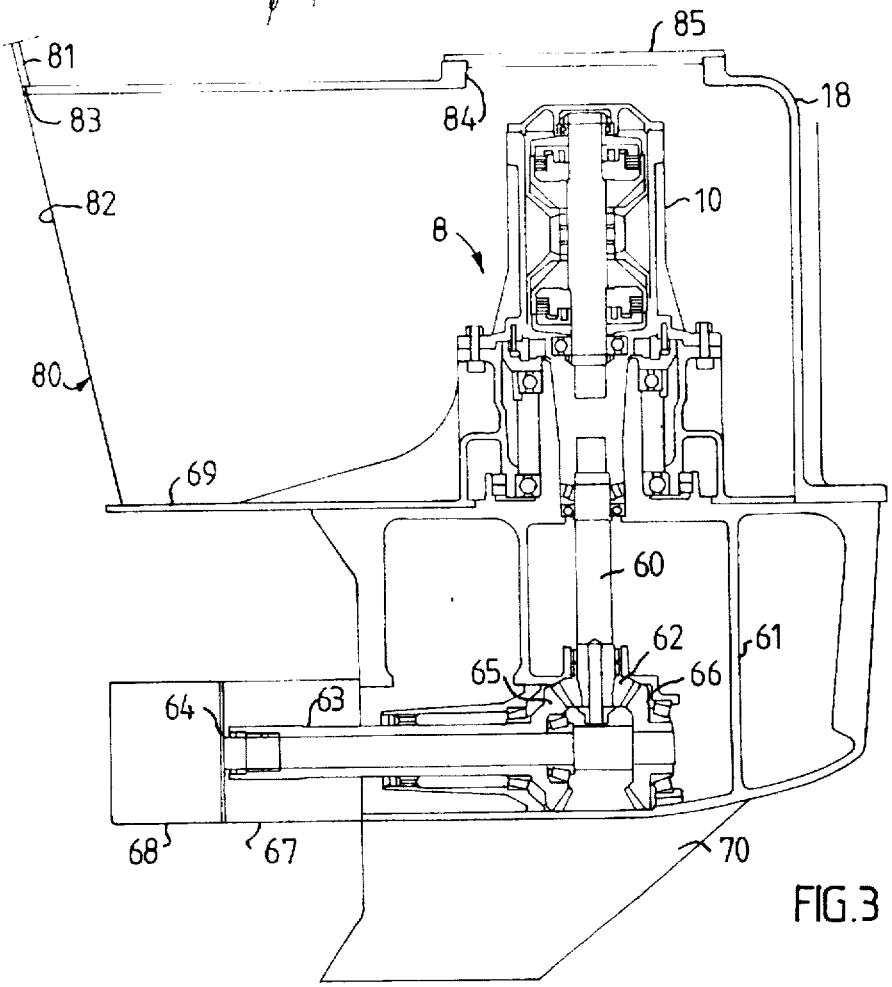
Figure 2:
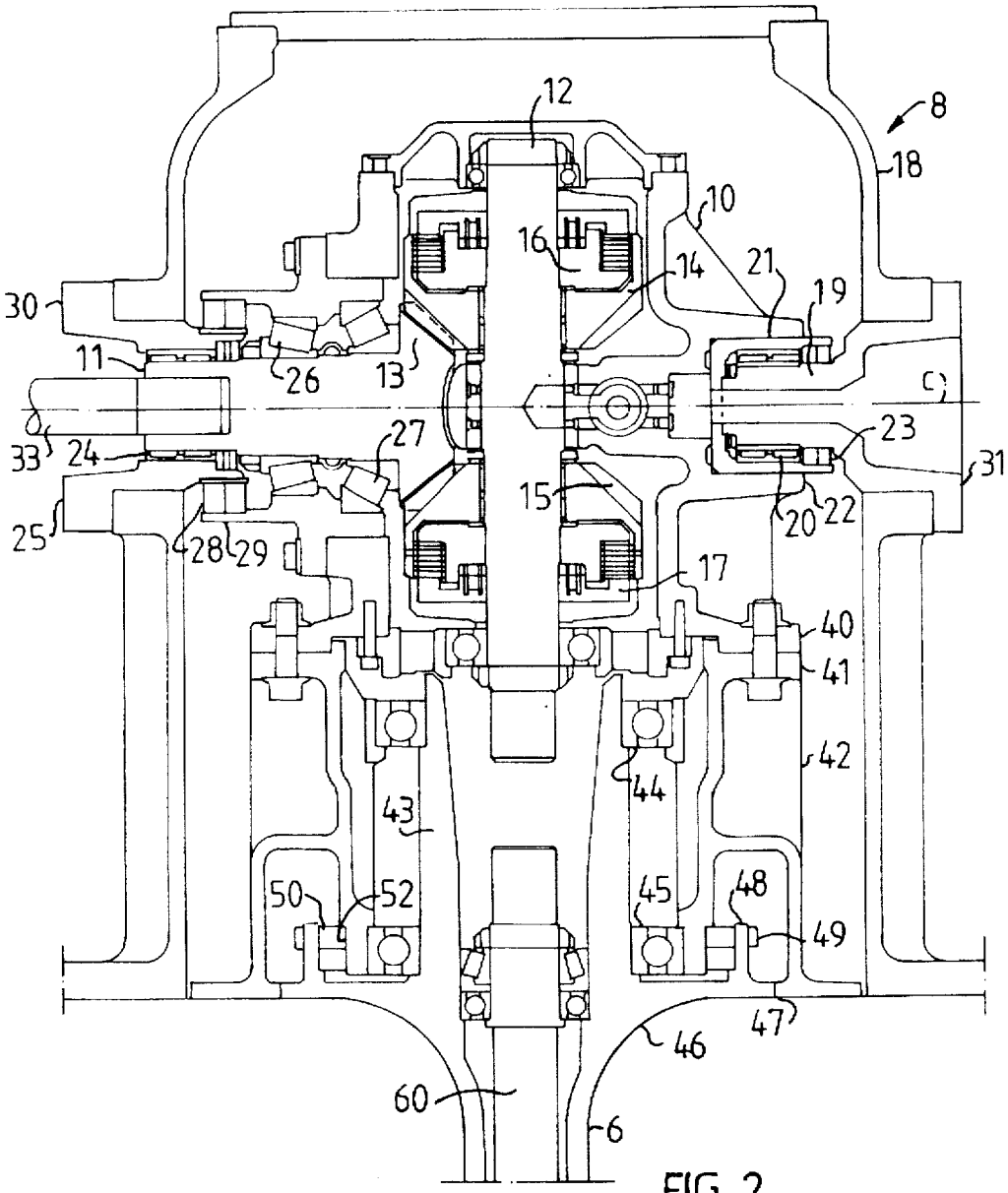
Figure 4:
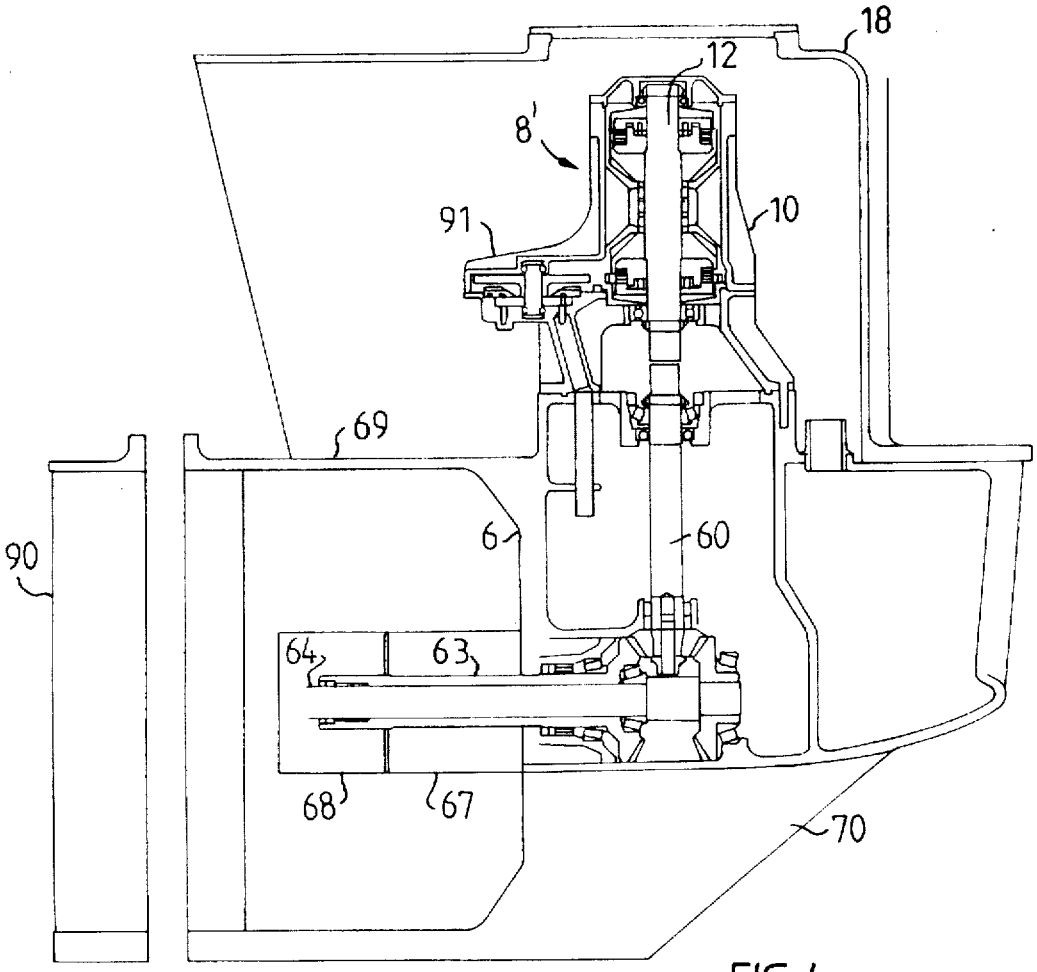

The invention will be described in more detail with reference to examples shown in the accompanying drawings, where FIG. 1 shows a cross section through a propeller drive installation according to the invention with twin propeller units, FIG. 2 is an enlargement of the left-hand drive unit shown in FIG. 1, FIG. 3 is a longitudinal section through a drive unit in FIG. 1, and FIG. 4 is a longitudinal section through a second embodiment of a propeller drive unit, which can be used in a propeller drive installation according to the invention.

In FIG. 1, the numeral 1 generally designates the bottom of a V-bottomed boat. In each bottom portion 2 and 3, respectively, there is an opening 4 and 5, respectively, through which there extends a leg 6 and 7, respectively, of a drive unit 8 and 9, respectively. The drive units 8 and 9 are identical with the exception that they are mirror images of each other, and the invention will in the following be described only with reference to the left-hand drive 8 with particular reference to FIG. 2.

The drive unit 8 has an upper transmission which comprises a gear housing 10, in which an input shaft 11 and an intermediate shaft 12 are rotatably mounted. The input shaft 11 has a conical gear 13 non-rotatably fixed to the shaft and which engages two gears 14, 15, which are freely rotatably mounted on the intermediate shaft and which are coordinated to individual clutches 16, 17, by means of which one or the other of the gears 14, 15 can be locked to the intermediate shaft. The clutches are placed outside the angle gearing formed of the conical gears 13, 14 and 15, i.e. on the sides of the gears 14, 15 facing away from each other, in order to place the gears 14, 15 close to each other. The reversing transmission described can be of the same type as is shown and described in SE-A-469 292, to which reference is made for further details.

The gear housing 10 is carried in the interior of a shell 18 which is open downwards and aft and is closed on the other sides. The shell 18 has on its right-hand side, as viewed in FIG. 2, a stub shaft 19 which is fixed in the side of the shell and carries a needle bearing 20 housed in a bearing cup 21 in a bearing seat 22 formed in the gear housing 10. The seals 23 between the stub shaft 19 and the cup 21 prevent water from penetrating into the bearing. The center axis "c" of the stub shaft 19 is coaxial with the rotational axis of the input shaft 11. The input shaft 11 is mounted, firstly, in a needle bearing 24 in a bearing retainer 25 fixed in the shell 18 and, secondly, in two conical roller bearings 26, 27 carried in bearing seats in the gear housing 10. Thus, the input shaft 11 also serves as a shaft end to enable, together with the stub shaft 19, the gear housing to pivot about the center axis "c", which is oriented athwartships, i.e. transversally to the length of the boat. Seals 28 between a flange 29 on the gear housing 10 and the outside of the bearing retainer 25 prevent water from penetrating into the gear housing. As can be seen in FIG. 2, the stub shaft 19 and the bearing retainer 25 have flange portions 30, 31 fixed (screwed) to the hood 18 and which are identical so that it will be easy to shift the input side for the input shaft 11, depending on whether the drive unit is to be coupled to the left-hand or right-hand side of a motor. The motor is coupled to the input shaft 11 via an angle gearing, which is schematically indicated and labelled 32 in FIG. 1. The output shaft 33 of the angle gearing (FIG. 2) is coupled via a splines connection to the input shaft 11. The embodiment described also permits operation with two motors, where an input shaft corresponding to shaft 11 is journalled in the drive unit on its right-hand side (FIG. 2). A drive installation can thus comprise one or two motors.

The lower portion of the gear housing 10 is provided with a flange 40, to which an upper flange 41 on a bearing housing 42 is screwed fast. In the bearing housing 42, there is mounted an upper portion 43 of the leg 6 (FIG. 1) mounted in ball bearings 44 and 45. At the lower edge area of the bearing housing 42, the leg has a mushroom-like portion 46, the outer edge 47 of which abuts the inner edge of the lower opening of the bearing housing. A vertical circular flange 48 extends from the portion 46 and has on its outer periphery a toothed rim 49 fixed thereto. The toothed rim 49 engages a gear which is driven by a servo motor (not shown) coupled to the boat steering. The seals 50 between the inside of the flange 48 and an opposite flange 51 on the bearing housing prevent penetration of water. The arrangement described permits rotation of the leg 6 relative to the upper gear housing 10 to steer the boat, and there is nothing in principle in the drive construction to prevent the drive unit from being rotated one complete turn. In practice, it can be advisable to arrange some sort of angular range limitation to limit the rotation to 90°. This in itself is a substantially larger steering angle range than what can be achieved with a conventional outboard drive unit carried on the transom, and it makes it possible, when docking and casting off, to allow the drive unit to work in the same manner as a bow propeller, i.e. only exerting lateral forces to the hull.

In the leg 6, there is an output shaft 60 mounted, which, via external splines and a splines sleeve (not shown), is non-rotatably joined to the intermediate shaft 12. The lower portion of the leg 6 forms a gear housing 61 (FIG. 3) for an angle gearing consisting of a driving conical gear 62 fixed to the output shaft 60, and two gears 65 and 66, respectively, fixed to individual propeller shafts 63 and 64, respectively. The arrangement is thus of a type which is known per se for counter-rotating twin propellers, for example, such propellers as are shown and described in U.S. Pat. No. 4,619,584 and U.S. Pat. No. Re 34011. FIGS. 3 and 4 only show schematically the propeller hub 67 and 68, respectively. It is also evident herefrom that the leg 6 is provided, in a known manner, with an anti-cavitation plate 69 and a skeg 70.

As was mentioned previously, the shell 18 is open backwards and downwards to permit the drive unit 6 to pivot. In FIG. 3, numeral 80 designates both the opening in the transom 81 of the boat and the rear opening of the shell 18. The edges 82 of the shell are sealed tightly to the edges 83 of the opening 80 in the transom. The top of the shell 18 directly above the gear housing 10 is provided with an opening 84 to permit inspection and service of the drive unit. The opening is normally closed by a cover 85.

In a twin drive installation with the drive unit embodiment described above with a leg 6 rotatably mounted in the gear housing 10, the drives are disposed inclined towards each other as can be seen in FIG. 1, and the drive units can then be used according to the invention as trim tabs. From the helm position, the legs 6 and 7 of the drive units can be turned not only in parallel for steering but also away from each other, i.e. corresponding to "toe-out", so that the steering forces will cancel each other. The inclination produces, however, vertical force components from the drive units, which cooperate to exert a lifting force on the boat transom, so that the boat will come up into its planing position more rapidly. The "toe-out" angle is set by means of a control (not shown) for the desired degree of trim. When turning, the angle set between the legs is maintained by a control unit (not shown) when the steering angle relative to the fore- and aft-line is changed. When the drive units are mounted perpendicular to the bottom of a V-bottomed boat, the inclination of the legs is obtained automatically.

FIG. 4 shows a second embodiment of a propeller drive. The details corresponding to those in FIGS. 1–3 have been given the same reference numerals as in said Figures. The drive unit 8' in FIG. 4 differs from the drive unit 8 essentially only in that its leg 6 is non-rotatably screwed to the gear housing 10 and that the skeg 70 has been extended aft, so that a rudder 90 can be mounted between it and the anti-cavitation plate 69 as is schematically indicated in FIG. 4. The oil pump 91 of the drive unit is also shown. The oil pump pumps oil from the lower portion of the leg serving as a sump to the gears and the bearings in the gear housing.

Between the propeller drive unit 8 and its support 18, hydraulic cylinders (not shown) are arranged, by means of which the drive unit can be trimmed and tilted. Blocking means, known per se, can also be arranged which, when the drive unit is affected by a predetermined rearwardly directed force, e.g. when running a ground, are released and permit the drive unit to be tilted up.

I claim:

1. Propeller drive installation in a boat, comprising at least two propeller drive units coupled to a drive plant, said drive units each having a first angle gearing enclosed in an upper gear housing and having first and second shafts, of which one is an input shaft intended to be coupled to a drive plant, and a drive unit leg extending downward from the upper gear housing with a second angle gearing enclosed in a lower gear housing and having at least one propeller shaft, wherein each of said propeller drive units (8, 9) comprises a reversing transmission and wherein the drive units (8, 9) are mounted beside each other with their respective said drive unit legs (6, 7) inclined relative to each other, so that a distance between the lower gear housings (61) is greater than the distance between the upper gear housings (10), and in that one of said drive unit legs is settable to turn the boat in one direction at the same time as the other of said legs is settable to turn the boat in the opposite direction, so that the counteracting horizontal force components cancel each other while the vertical force components are added to each other to trim the running position of the boat in the water.

2. Propeller drive installation according to claim 1, wherein the drive unit legs (6, 7) each extend through individual openings (4, 5) in the bottom (1) of a V-bottomed boat, and in that the lower gear housing (61) of each of the legs is mounted to pivot relative to the upper gear housing (10) about an axis coinciding with the rotational axis of the second shaft (12) of the upper angle gearing.

3. Propeller drive installation according to claim 2, wherein each of the drive unit legs (6, 7) has an upper portion (43), which extends into and is mounted in anti-friction bearings (44, 45) in a bearing housing (42) fixed to the upper gear housing.

* * * * *